US009182201B2

(12) United States Patent
Coffman, II

(10) Patent No.: US 9,182,201 B2
(45) Date of Patent: Nov. 10, 2015

(54) CARTRIDGE WITH RAPIDLY INCREASING SEQUENTIAL IGNITIONS FOR GUNS AND ORDNANCES

(71) Applicant: Charles W. Coffman, II, Austin, TX (US)

(72) Inventor: Charles W. Coffman, II, Austin, TX (US)

( * ) Notice: Subject to any disclaimer, the term of this patent is extended or adjusted under 35 U.S.C. 154(b) by 0 days.

(21) Appl. No.: 13/857,814

(22) Filed: Apr. 5, 2013

(65) Prior Publication Data

US 2013/0305950 A1 Nov. 21, 2013

Related U.S. Application Data

(60) Provisional application No. 61/621,040, filed on Apr. 6, 2012.

(51) Int. Cl.
*F42B 5/26* (2006.01)
*F42B 5/16* (2006.01)

(52) U.S. Cl.
CPC .... *F42B 5/26* (2013.01); *F42B 5/16* (2013.01)

(58) Field of Classification Search
CPC ..... F42B 5/16; F42B 5/181; F42B 5/045; F42B 5/38; F42B 5/105
USPC ..... 102/352, 443, 433, 434, 464, 283, 285, 102/286, 287, 289, 705
See application file for complete search history.

(56) References Cited

U.S. PATENT DOCUMENTS

| | | | | |
|---|---|---|---|---|
| 34,615 A | | 3/1862 | Shannon | |
| 751,519 A | | 2/1904 | Kilzer | |
| 1,920,075 A | | 7/1933 | Haenichen | |
| 2,072,671 A | | 3/1937 | Foulke | |
| 2,600,678 A | * | 6/1952 | O'Neill, Jr. | 102/287 |
| 3,648,616 A | * | 3/1972 | Hsu | 102/443 |
| 4,593,622 A | | 6/1986 | Fibranz | |
| 5,031,541 A | | 7/1991 | Gardner et al. | |
| 5,421,264 A | * | 6/1995 | Petrick | 102/443 |
| 5,510,062 A | | 4/1996 | O'Meara et al. | |

FOREIGN PATENT DOCUMENTS

WO WO03006917 1/2003

OTHER PUBLICATIONS http://www.thehighroad.org/archive/index.php/t-540501.html ; Oct. 26, 2010; p. 4.*
http://www.go2gbo.com/forums/ask-veral-smith-of-lbt-qa/duplex-loads-122511/?PHPSESSID=hst5ctf4kl0p3d3v9p5mac5t87 ; Jul. 27, 2007; pp. 2-3.*

* cited by examiner

*Primary Examiner* — Samir Abdosh
*Assistant Examiner* — John D Cooper

(57) ABSTRACT

A cartridge may be loaded with a powder column containing stratified, stacked layers of propellant, each powder layer over-compressed to a specified degree, with the burn rate controlled by the specified degree of over-compression applied to each respective powder layer. The application of a highly compressed powder column reduces the burn rate, and may force one or more of the powder layers to launch with the projectile down the barrel. Accordingly, the powder column is forced to burn in a manner similar to fuel burning in a solid fuel rocket engine. This greatly reduces the pressure(s) developed in the chamber, and permits the force of the burning powder to be efficiently focused on forward propulsion. The rapidly increasing set of sequential ignitions provides higher and higher energy densities with each subsequent ignition, and creates a more uniform linear acceleration of the projectile for the full length of the target barrel.

17 Claims, 13 Drawing Sheets

CARTRIDGE WITH RAPIDLY INCREASING SEQUENTIAL IGNITIONS FOR GUNS AND ORDNANCES

PRIORITY CLAIM

This application claims benefit of priority of U.S. provisional application Ser. No. 61/621,040 titled "Cartridge with Rapidly Increasing Sequential Ignitions for Guns and Ordnances", filed Apr. 6, 2012, which is hereby incorporated by reference in its entirety as though fully and completely set forth herein.

BACKGROUND OF THE INVENTION

1. Field of the Invention

This invention relates generally to cartridges for guns and ordnances, and more specifically to cartridges having rapidly increasing sequential ignitions.

2. Description of the Related Art

Most projectiles are conventionally accelerated using chamber-based systems, in which a pressure spike is created in a cartridge. Following that pressure spike, the ability to accelerate a projectile using the full length of a desired barrel is greatly diminished, resulting in an untapped potential of the barrel length for optimized acceleration. The most common approach to solving this problem has been the use of stratified propellants, or blended powders using regular powders intermixed with powder containing chemical retardants to slow the natural burn rate of the powder to extend the burn further down the barrel. Both methods add unnecessary cost and complexity to manufacturing the desired cartridge-based solutions. Most stratified propellant approaches utilize a lacquer or resin that must cure prior to loading the next layer of powder, which is undesirable during commercial manufacturing. Another approach has been the use of spacers, typically consisting of metal, felt, or other similar materials placed between powder layers to deflagrate the natural burn rate. These methods can reduce the case volume and present mass production challenges in the insertion process. Powders with retardants are less efficient, more costly, and are limited in their ability to provide ever-increasing pressure for the full length of a barrel. Duplex loads have also been attempted, whereby a layer of one type of powder is stacked directly above a layer of another type of powder without a barrier. This method, however, has been minimally effective, as a flashover of both powders can occur. The second layer of powder can only burn slightly faster, or the flashover of the two powders can create dangerous pressures and lower velocities. Some prior art solutions are presented below for reference.

U.S. Pat. No. 34,615, A. Shannon in 1862 references perforated diaphragms whereby the number of perforations determines the burn rate between layers.

U.S. Pat. No. 751,519 describes the use of tinfoil or felt diaphragms to slow the burn rate between layers.

U.S. Pat. No. 1,920,075 describes the use of lacquer or salt discs to separate layers as well as igniting from the front and moving rearward.

U.S. Pat. No. 2,072,671 describes cellulose capsules mixed throughout powder intended to delay the second ignition.

U.S. Pat. No. 4,593,622 describes using gas permeable barriers to separate charges.

U.S. Pat. No. 5,031,541 describes the use of a hermetic barrier comprised of polymeric resin and a support disc.

U.S. Pat. No. 5,510,062 describes the uses of a cellulosic thermoplastic deterrent or burn rate modifier.

There exists, therefore, a need for a simpler, more efficient way to manufacture cartridges that can accelerate a projectile to higher velocities with lower pressures and recoil.

SUMMARY

Various embodiments include cartridges containing stratified powder column, in which each stratus may be a stacked layer of propellant over-compressed to a specified degree, with the burn rate of the stacked layer of propellant controlled by the specified degree of over-compression applied to each respective powder layer. The stratified powder column facilitates the expulsion of hyper-velocity projectiles from a barrel through highly compressed rapidly increasing sequential detonations. In other words, the projectiles may obtaining hyper-velocities via mechanical separation of different propellants in the powder column, which more efficiently increases velocity and pressure curve the full length of a desired barrel. Furthermore, the separation of the various layers (strata) of propellants, (or gunpowder or charges) may be stacked without a barrier of any kind disposed between the layers. That is, the stratified powder column may be constructed without a hermetic barrier separating the charges from one another.

As previously mentioned, conventional means of expelling projectiles typically include chamber based systems in which the projectile is inserted into a cartridge containing propellant(s) (i.e. [gun] powder or charge). Igniting the propellant(s) creates a pressure spike, which eventually fades, thereby diminishing the ability to accelerate a projectile using the full length of a desired barrel. This results in untapped potential of the barrel length for optimizing acceleration. In one set of embodiments, the potential of the full barrel length is exploited by achieving a pressure spike(s) corresponding to a power/pressure curve(s) that yields acceleration of the bullet/projectile through the full length of the barrel, compared to conventional pressure curves that peak rapidly and gradually diminish over the full length of the barrel.

As also previously mentioned, current methods attempt to achieve better performance by using center-fire cartridges and smokeless propellants. While center-fire cartridges provide a more consistent source of ignition over previous types, they inherently force an ignition through the center of the powder. This creates high outward pressures and dangerous ("detonation") issues when the primer flashes over high-energy low-volume powder charges, causing a rapid increase in pressure sufficient to blow up a firearm. While significant advancements have been made in the design and manufacture of modern day propellants, the full potential of a given powder is still untapped due to a single source of detonation from the chamber. The use of retardants and coatings to effectively reduce a powder's efficiency, in order to attempt to elongate the pressure curve further down the barrel has enjoyed some success. However, most current methods lack the ability to increase the force applied to the projectile at its most critical stage of having obtained minimal velocity, beyond that provided by the initial pressure spike, or by the delay of the pressure level.

Various embodiments of cartridges and stratified powder (propellant) columns presented herein provide significant improvement over previous attempts to adequately use barriers in multi-staged propellant systems. Compressed and stacked layers of powder may be configured such that a delay of the burn rate between the different layers is controlled by the level of compression of each layer. Such a propulsion method reduces outward pressures on the chamber and barrel, and focuses more of the energy directly into forward movement or acceleration of the projectile. A first layer or base charge may be disposed as the optimal propellant charge associated with maximum chamber pressure, to ensure that the next sequential detonation occurs after the bullet/projectile is in motion, and the volume of the case and barrel increase prior to the introduction of the next, higher energy propellant.

A more gradual power curve of acceleration may be achieved, resulting in lower G-forces, recoil, and substantial gains in overall velocity. In one set of embodiments, slower powders may be used to provide a sufficient push for the projectile. While in many cases such propellants are more desirable, they tend to burn less efficiently, resulting in a dirtier, less efficient burn. They may also ignite in an inconsistent manner, which can result in a dangerous situation such as a bullet remaining lodged in the barrel. The use of ever increasing faster burn rate powders more efficiently "back burn" the previous powders. Producing carefully controlled rapidly increasing sequential detonations provides an effective means of increasing the forward pressure of constant force applied to the projectile well beyond the distance achieved by traditional methods from a single ignition originating at the chamber. By more efficiently accelerating the projectile, substantial improvements in velocity may be achieved, delivering the same level of foot-pounds energy using substantially more compact cartridges than the cartridges required in current solutions.

In one set of embodiments, a cartridge may be loaded with a stratified powder column containing stacked layers of propellant, with each powder layer over-compressed to a specified degree. The different layers of propellant (or powder/charge) may be directly stacked on top of each other without any barriers (e.g. hermetic barriers) separating the layers. The burn rate of each respective powder layer may be controlled by the specified degree of over-compression applied to the respective powder layer. The application of a highly compressed powder column reduces the burn rate, and may force one or more of the powder layers to ignite with the projectile down the barrel. Accordingly, the powder column is forced to burn in stages reminiscent to fuel burning in a solid-fuel rocket engine. This greatly reduces the pressure(s) developed in the chamber, and permits the force of the burning powder to be efficiently focused on forward propulsion. The rapidly increasing set of sequential ignitions provides higher and higher energy densities with each subsequent ignition, and creates a more uniform linear acceleration of the projectile for the full length of the target barrel.

According to one embodiment, a cartridge is filled by a booster stage powder that is traditionally too slow for that cartridge, starting with a safe powder charge. The charge is then increased in increments of 0.1 grains until the powder becomes compressed. The resulting velocity of the load is chronographically measured, and the powder charge is increased until the cartridge is so heavily compressed that an actual reduction in velocity is observed. The total charge in grains is noted at the point where the velocity gains fall off, and is considered the base charge. The base charge is then reduced by 0.1 grains, and replaced by 0.1 grains layer on top a desired faster powder to retain the same level of compression as more layers of higher density/faster burning powders are introduced.

BRIEF DESCRIPTION OF THE DRAWINGS

FIG. 14 is an illustration of a compressed stratified powder load prior to being ignited;

FIG. 15 is an illustration of stage one of a compressed stratified powder load after ignition;

FIG. 16 is an illustration of stage 2 of a compressed stratified powder load after ignition;

FIG. 17 is an illustration of stage 3 of a compressed stratified powder load after ignition;

FIG. 18 is an illustration of stage 4 of a compressed stratified powder load after ignition;

FIG. 19 is an illustration of stage 4 of a compressed stratified powder load after complete burn;

FIG. 20 is an illustration of how the final stage burn flashes back to insure a more complete burn of the previous powders:

DETAILED DESCRIPTION

Figure 1:
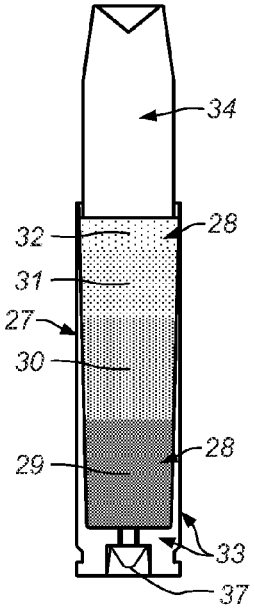
FIG. 1 is an illustration of a stratified powder load prior to compression.

In one set of embodiments, a cartridge may be loaded with a powder column of stratified or stacked layers of propellant, whereby each powder layer in the powder column is over-compressed to a specified degree, and the burn rate or modifier between layers may be controlled by the specified degree of over-compression applied to each respective powder layer of the powder column. More broadly, rapidly increasing faster powders may be provided in sequence, and instead of using complex barrier methods, the rate of burn between layers may be controlled by the volume of the layer and the amount of compression introduced to the layer.

Rather than attempting to extend the force applied from the chamber down the full length of a barrel, the application of a highly compressed powder column reduces the burn rate, and in some cases forces one or more of the powder layers to launch with the projectile down the barrel. In doing so, the powder column is forced to burn similar to the manner in which fuel is burned in a solid fuel rocket engine rather than the manner in which powder is traditionally ignited. This greatly reduces the pressure(s) developed in the chamber, and permits the burning powder force to be efficiently focused on forward propulsion. This rapidly increasing set of sequential ignitions provides more efficient and effective means of increasing the forward pressure or constant forced applied to the projectile well beyond the distance achieved through traditional methods through a single ignition originating in the chamber.

Unlike modifiers that have to be designed for a very specific purpose or burn rate, various embodiments described herein may be optimized by tweaking or making minor adjustments to the degree of compression applied to the powder column. Unlike typical chamber-based systems, embodiments of various methods presented herein make it possible to achieve substantially higher velocities from most existing cartridge form-factors. A first layer or base charge may allow for the optimal propellant charge associated with maximum chamber pressures, and may ensure that the next sequential detonation occurs after the bullet (projectile) is in motion, and the volume of the barrel between the case and the projectile have increased prior to the next higher energy propellant being introduced. This rapidly increasing set of sequential ignitions with higher and higher energy densities creates a more uniform linear and/or exponential acceleration of the projectile for the full length of the target barrel.

In one set of embodiments, stratified layers may be obtained by using stackable discs or pellets with similar burn characteristics as the aforementioned compressed layers.

This more uniform linear and/or exponential acceleration or more gradual power curve of acceleration results in lower G-forces, lower subsequent projectile deformity, and less forceful recoil, while allowing for substantial gains in overall projectile velocity. In one embodiment, slower powders are used to provide the initial push or beginning of the accelerating of a projectile. While in many cases slower propellants are more desirable, they tend to burn less efficiently, which results in a dirtier, less efficient burn. Some slower propellants are also inherently plagued with inconsistent ignition issues, which can result in dangerous situations, such as a bullet remaining lodged in a barrel.

In one set of embodiments, faster burning powders may be provided in rapidly increasing sequence, to efficiently "back burn" powders that were previously introduced during the burn process. Powders with higher energy densities and/or powders known to have clean burning attributes can be added to the later stages to ensure the previously introduced (burned) powders are completely burned prior to leaving the barrel, resulting in a cleaner burn with fewer emissions, which is particularly advantageous for indoor shooting ranges.

As previously mentioned, instead of using complex barrier methods or retarded powders, the rate of burn between powder layers may be controlled by the respective volumes of the powder layers, and the degree of compression of each powder layer. In one set of embodiments, a starting point may include choosing a booster stage powder that is traditionally too slow for the respective cartridge to be used, even if the case (cartridge) is completely filled. Starting with a safe uncompressed powder charge, the charge may then be increased by one tenth (0.1) of a grain at a time until the powder becomes compressed. While manufacturers occasionally use compressed loads, they rarely if ever use more than several tenths of a grain of powder. In various embodiments, significant compression may be introduced, for example in the 2-3 grain range. The powder charge may be increased by a tenth of a grain in the projectile/cartridge assembly, and the velocity of the load may be chronographed during a test. This may be continually performed until the cartridge is so heavily compressed that an actual reduction in velocity is observed. The total charge in grains may be noted at the point the velocity gains fall off. This charge in grains may be considered the base charge. From that point, the base charge may be reduced by 0.1 grains, and replaced by 0.1 grains layer on top a desired faster powder, to retain the same level of compression as more layers of higher density/faster burning powders are introduced. It may be necessary to slightly raise the compression level, especially when adding powders that don't have the same volume and weight as the booster stage. This process may be continued until you the desired number of layers or stages have been added. It should be noted that if the base charge is reduced too much, a flash over to the secondary charge may occur, potentially creating dangerous pressure levels.

During field tests, the following results have been obtained for a 9 mm cartridge/projectile, from a 5" semi-automatic weapon. Factory 9 mm 147 grain bullet reached an average 975 feet per second (fps) with 310 foot pounds (ft lbs) of energy. A custom bullet in a 357 Coffman (9 mm form factor) cartridge reached 1500 fps with 734 ft lbs of energy. A factory 9 mm 125 grain bullet reached an average 1,150 fps with 367 ft lbs of energy, while a custom 357 Coffman bullet reached 1,700 fps with 802 ft lbs of energy. A factory 9 mm 115 grain bullet reached an average speed of 1,300 fps with 338 ft lbs of energy, while a custom 357 Coffman bullet reached 1,850 fps with 874 ft lbs of energy. Finally, a factory 9mm 90 grain bullet reached an average speed of 1,400 fps with 392 ft lbs of energy, while a custom 357 Coffman bullet reached a speed of 2,025 fps with 820 ft lbs of energy.

FIG. 1 shows an illustration of one embodiment of a cartridge 27 with a stratified powder column 28 comprising a base charge (or booster layer) 29, a second charge 30, a third charge 31 and a final charge of powder 32 contained within the casing 33 with a projectile 34 seated loosely at the top of the cartridge 27. The four charges may each have a different burn rate. Accordingly, a propellant charge for use in a cartridge (e.g. cartridge 27) may include multiple propellant layers stratified in a stacked column, where each propellant layer is over-compressed to a specified degree, and a respective burn rate of each propellant layer is controlled by a specified volume of the respective propellant layer and the specified degree of over-compression applied to the respective propellant layer. The specified degree of over-compression applied to a first propellant layer (e.g. layer 29) may result in a burn rate corresponding to a maximum chamber pressure of the cartridge. The first propellant layer may therefore be considered a booster layer, with the specified degree of over-compression applied to the booster layer resulting in a next sequential detonation, following detonation of the booster layer during firing of a projectile (e.g. projectile 34) from the cartridge, to occur after the projectile in is motion.

Figure 2:
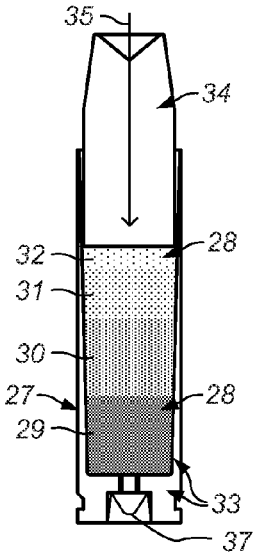
FIG. 2 is an illustration of a stratified powder load after compression.

FIG. 2 shows an illustration of how when the projectile 34 is seated fully 35 into the case 33, compression of the powder column 28 will occur so that the final cartridge 27 is under full compression 35.

Figure 3:
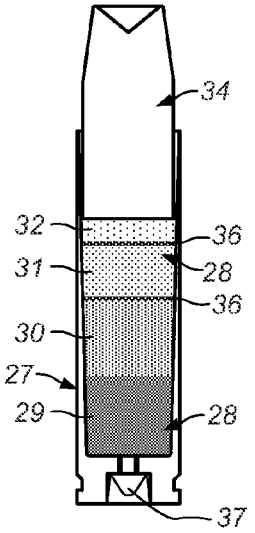
FIG. 3 is an illustration of a compressed stratified powder load with additional buffer layers.

FIG. 3 shows an illustration of another embodiment of a cartridge 27 whereby the powder column 28 also includes buffer layers 36 above the booster powder 29 to add to the delay of ignition between the stratified layers of the powder column 28.

Figure 4:
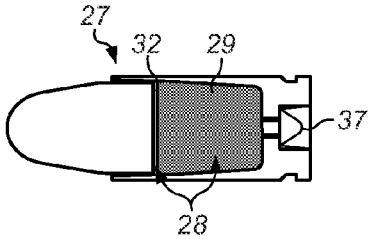
FIG. 4 is an illustration of a compressed stratified powder load with booster and final stage.

FIG. 4 shows an illustration of another embodiment of a cartridge 27 with a booster charge (stage/layer) 29 and a final charge (stage/layer) 32.

Figure 5:
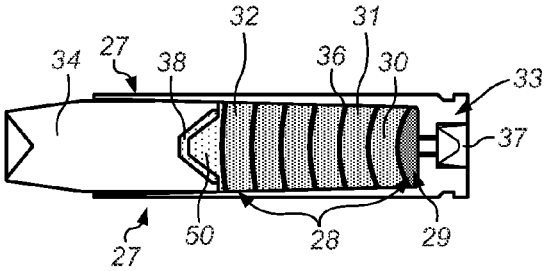
FIG. 5 is an illustration of a compressed stratified powder load with additional buffer layers and shaped charge for final stage.

FIG. 5 shows an illustration of another embodiment of a cartridge 27 with a primer 37 and a stratified powder column 28 that includes a base charge 29, a second charge 30, a third charge 31, a last powder charge 32, and a final shaped charge 50 of high explosive similar to the primer 37 contained within the casing 33. A projectile 34 is seated firmly at the top of the cartridge 27. It should be noted that the powder buffers 36 may also be in the form of a shaped charge.

Figure 6:
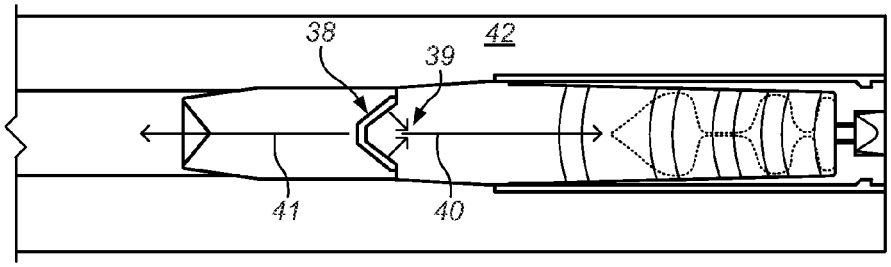
FIG. 6 shows forces applied with shaped charge.

FIG. 6 shows an illustration of how forces of a shaped charge 38 are directed towards one another at an angle and are deflected (39) to create a charge directed completely rearward (40) so as to maximize forward momentum (41) with minimal outward forces on the barrel 42.

Figure 7:
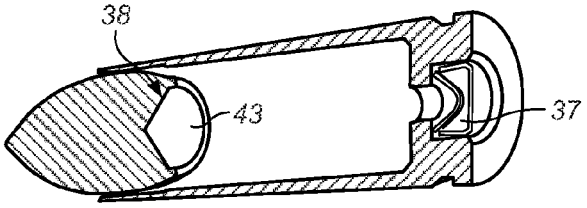
FIG. 7 illustrates how shaped charge can be seated in the base of the bullet.

FIG. 7 shows an illustration of how a shaped charge 38 can be press fitted like a primer 37 directly into a pocket in the projectile 43.

Figure 8:
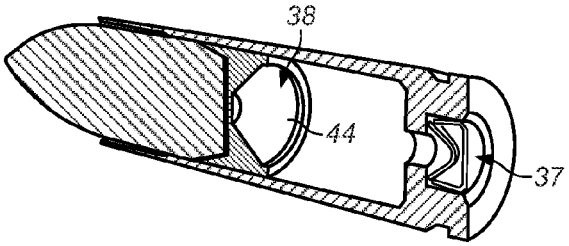
FIG. 8 illustrates how shaped charge can be seated in a bullet base cup.

FIG. 8 shows an illustration of another embodiment whereby the shaped charge 38 may be press fitted into a projectile base cup 44.

Figure 9:
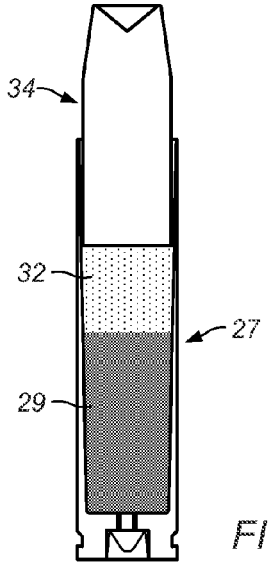
FIG. 9 is an illustration of an uncompressed two stage stratified powder load.

FIG. 9 shows an illustration of a cartridge 27 with a duplex stratified powder layer consisting of a first charge 29 and final charge 32, with a projectile 34 lodged atop the cartridge 27.

Figure 10:
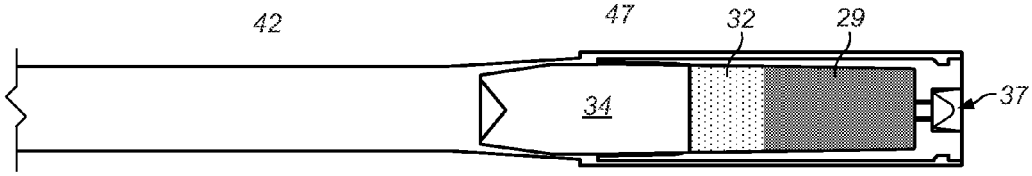
FIG. 10 is an illustration of an uncompressed two stage stratified powder load in barrel.

FIG. 10 shows an illustration of the cartridge 27 of FIG. 9 loaded into the chamber 47 of a barrel 42 ready to detonate the primer 37 to ignite the booster charge 29 and the final charge 32 to propel the projectile 34 down the barrel 42.

Figure 11:
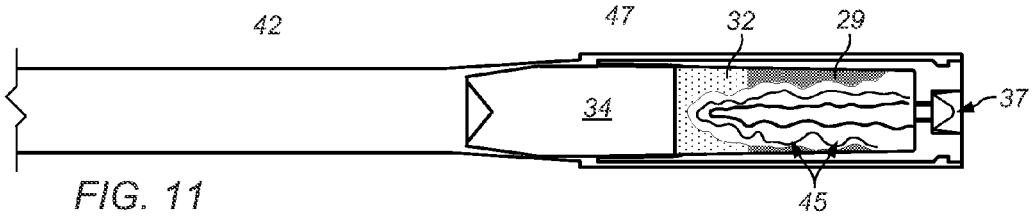
FIG. 11 is an illustration of flashover that occurs with two stage stratified powder load in barrel without compression or barrier.

FIG. 11 shows an illustration of the flashover 45 that occurs when stratified layers of powders 29 & 32 are ignited by the detonation of the primer 37 when there is no barrier or compression to prevent both charges 29 & 32 from igniting at the same time. This can result in dangerous pressure levels and lower velocity.

Figure 12:
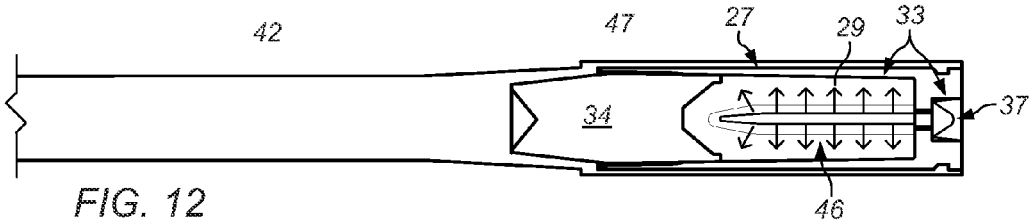
FIG. 12 is an illustration of outward forces on an uncompressed load in chamber.

FIG. 12 shows an illustration of the outward forces 46 upon the case 33 and chamber 47 when the detonation of the primer 37 ignites the powder 46 of a traditional cartridge 27.

Figure 13:
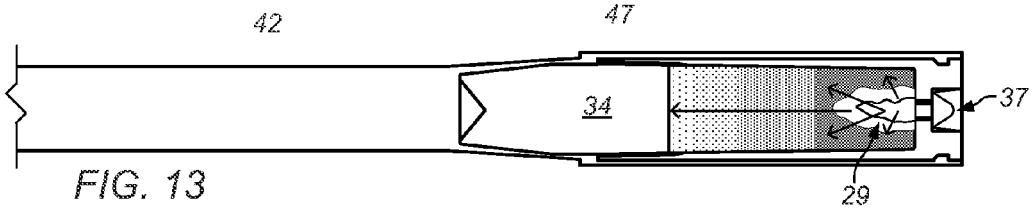
FIG. 13 is an illustration of forward forces of a compressed stratified powder load after ignition.

FIG. 13 shows an illustration of the stratified layers under compression being ignited by the detonation of the primer 37. The initial ignition is contained within the booster charge 29 and more efficiently directs the propulsion of the projectile 34 down the barrel 42 with lower chamber 47 pressures.

Figure 14:
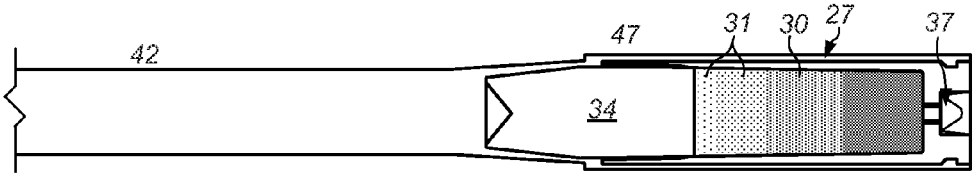
FIG. 14-20 are an illustration of the various stages of the stratified powders being ignited.

FIG. 14 shows an illustration of the stratified layers under compression with the cartridge 27 loaded into the chamber 47.

Figure 15:
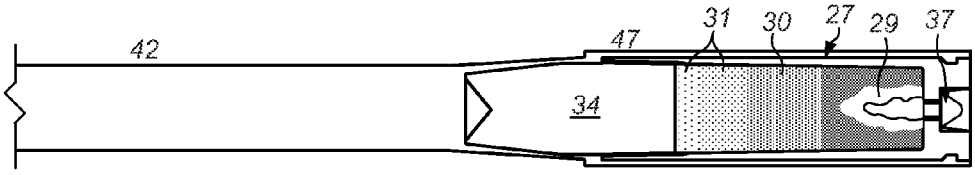

FIG. 15 shows an illustration of the stratified layers under compression with the cartridge 27 loaded into the chamber 47 and the detonation of the primer ignition contained within the booster powder stage 29.

Figure 16:
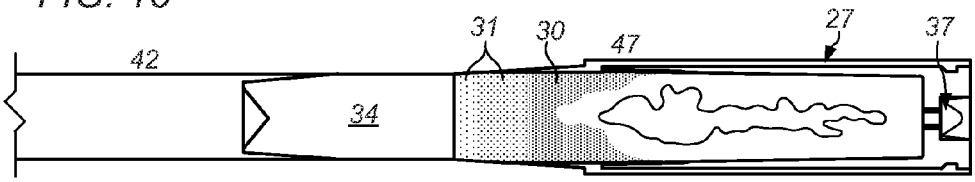

FIG. 16 shows an illustration of the second (30), third (31) and final (32) stages of the powder column being propelled forward along with the projectile 34 burning from the rear forward.

Figure 17:
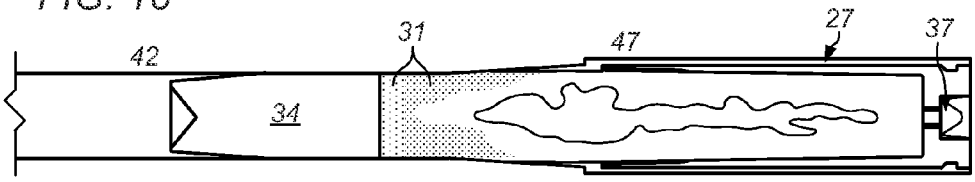

FIG. 17 shows an illustration of the third (31) and final (32) stages of the powder column being propelled forward along with the projectile 34 burning from the rear forward.

Figure 18:
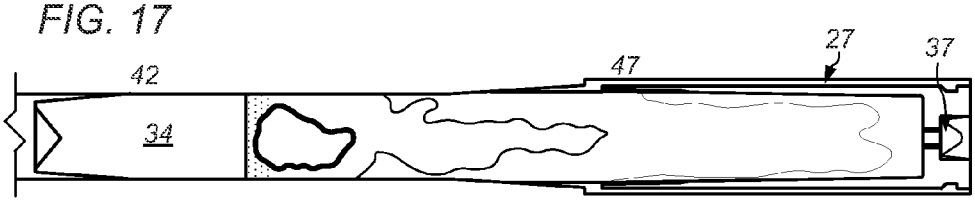

FIG. 18 shows an illustration of the final stage 32 of the powder column being propelled forward along with the projectile 34 burning from the rear forward.

Figure 19:
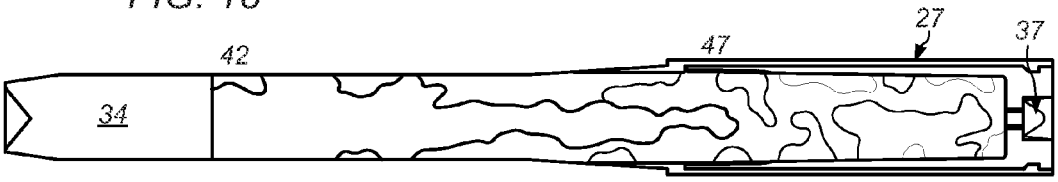

FIG. 19 shows an illustration of the final stage 32 of the powder column after complete burn being propelled forward along with the projectile 34 burning from the rear forward.

Figure 20:
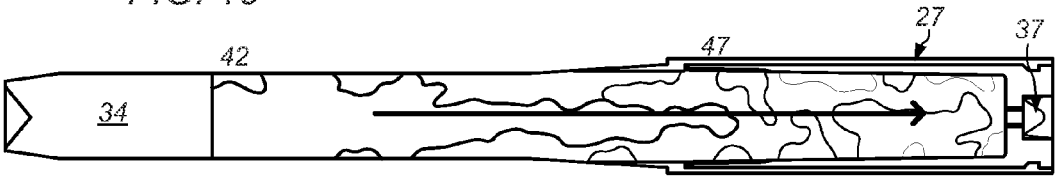

FIG. 20 shows an illustration of the final stage 32 of the powder column after complete ignition burning backwards to completely burn any remaining powder from previous stages while propelling projectile 34 forward.

Therefore, as illustrated in FIGS. 1-20, various embodiments of a cartridge manufactured according to the system and method described herein may include a casing, a propellant chamber situated in the casing, and a powder column situated in the propellant chamber. The powder column may include stratified stacked propellant layers, with each respective propellant layer over-compressed to a specified degree, and a respective burn rate of each respective propellant layer controlled by the specified degree of over compression applied to the respective propellant layer. The cartridge may further include a projectile secured to the casing above the propellant chamber, and a top propellant layer may be press fitted into a base cup of the projectile. A bottom propellant layer may press fitted at the bottom of the powder column may be considered a booster layer, with the specified degree of over-compression applied to the booster layer resulting in a next sequential detonation—following detonation of the booster layer during firing of the projectile—to occur after the projectile in is already in motion. Furthermore, the specified degree of over-compression applied to the booster layer may also result in a volume of the casing increasing prior to detonation of a next propellant layer of the stratified stacked propellant layers following detonation of the booster layer during firing of the projectile.

The powder column may be press fitted such that when firing the projectile from the cartridge through the barrel of a firearm, the powder column is completely burned up by the time the projectile leaves the barrel. Overall, the specified degree of over-compression applied to each propellant layer results in a rapidly increasing set of sequential ignitions during firing of the projective from the cartridge through a barrel, with each successive ignition of the set of sequential ignitions providing a higher energy density, and creating a more uniform linear acceleration of the projectile for the full length of the barrel. The respective burn rate of each respective propellant layer may be further controlled by a specified volume of the respective propellant layer, and adjacent propellant layers may be press fitted without separating the layers by hermetic barriers.

Figure 21:
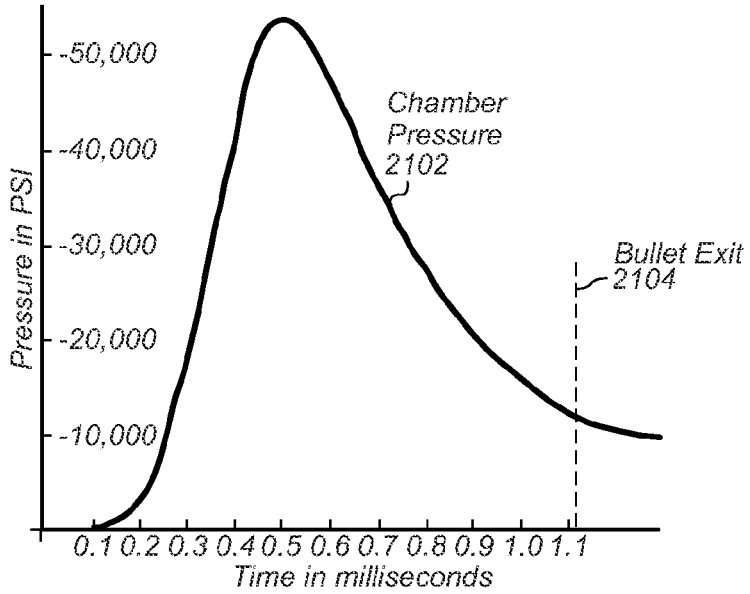
FIG. 21 is an illustration of the pressure curve associated with a typical chamber.
Figure 22:
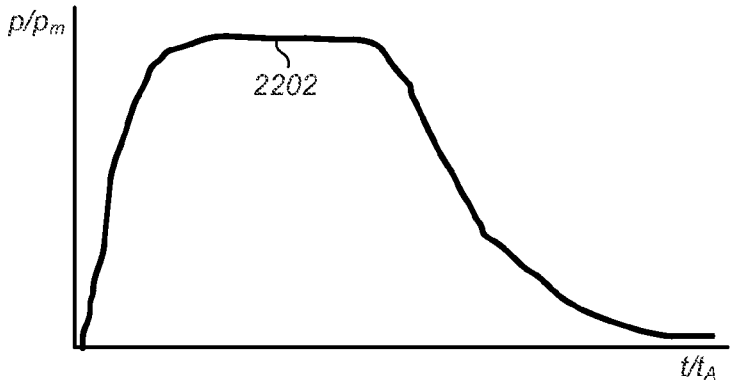
FIG. 22 is an illustration of the pressure curve associated with the chamber of a magnum cartridge.
Figure 23:
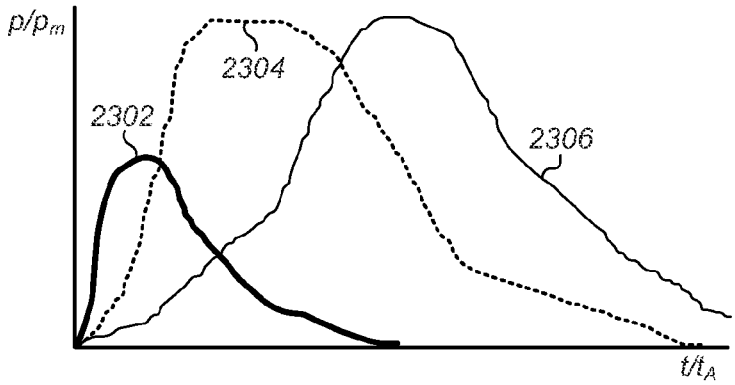
FIG. 23 is an illustration of the pressure curves associated with a retarded hybrid blended powder.
Figure 24A:
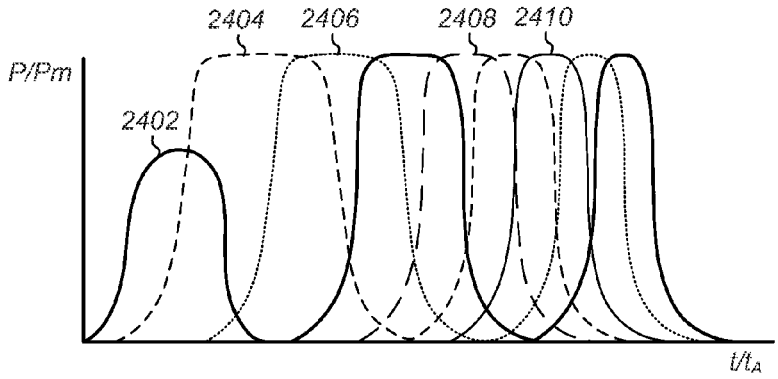
FIG. 24A is an illustration of the pressure curves associated with a compressed stratified powder load.
Figure 24B:
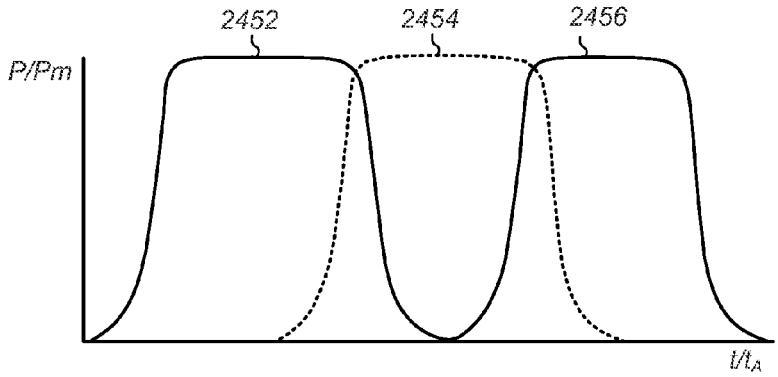
FIG. 24B is an illustration of pressure curves representative of uniform linear acceleration.
Figure 25:
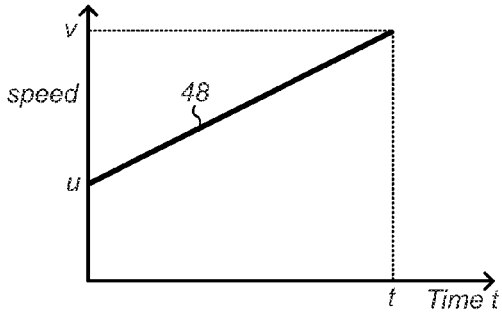
FIG. 25 is an illustration of uniform linear acceleration of a compressed stratified load.
Figure 26:
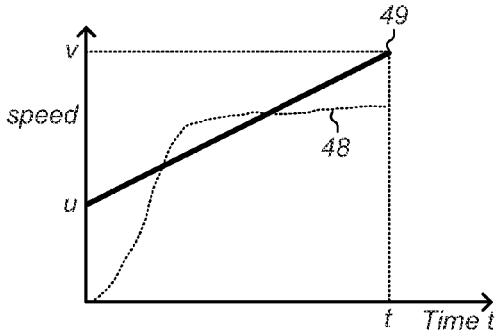
FIG. 26 is an illustration of uniform linear acceleration motion of a compressed stratified load vs. typical projectile acceleration.

FIG. 21 shows an illustration of the pressure curve 2102 associated with a typical cartridge. The bullet exit 2104 is indicated at around 1.1 milliseconds (ms). FIG. 22 shows an illustration of the pressure curve 2202 of a chamber pressure of a magnum cartridge, indicating the chamber pressure versus elapsed time. FIG. 23 shows an illustration of the respective pressure curves for a retarded hybrid blended powder. As shown in FIG. 23, pressure curves 2302, 2304, and 2306 respectively correspond to delayed ignitions. FIG. 24A shows an illustration of the uniform linear acceleration of a compressed stratified load, represented by pressure curves 2402, 2404, 2406, 2408, and 2410. FIG. 24B shows an illustration of the uniform linear acceleration indicating three pressure curves 2452, 2454, and 2456. FIG. 25 shows an illustration of the equation for uniform linear acceleration of a compressed stratified load, indicated by linear function 48, representing speed versus elapsed time. FIG. 26 shows an illustration of the graph of conventional cartridge acceleration represented by curve 48 versus time, in contrast to the uniform linear acceleration of the compressed stratified powder loaded cartridge, represented by curve 49.

FIGS. 27-33 show various embodiments of cartridges manufactured according to the principles presented herein and described in more detail above. All dimensions within square brackets "[ . . . ]" are in millimeters, and the dimensions shown are to intersection of lines. All calculations apply at maximum material condition. It should be noted that these are physical examples of possible embodiments manufactured according to the systems and methods presented herein, and other embodiments are possible and are contemplated.

Figure 27:
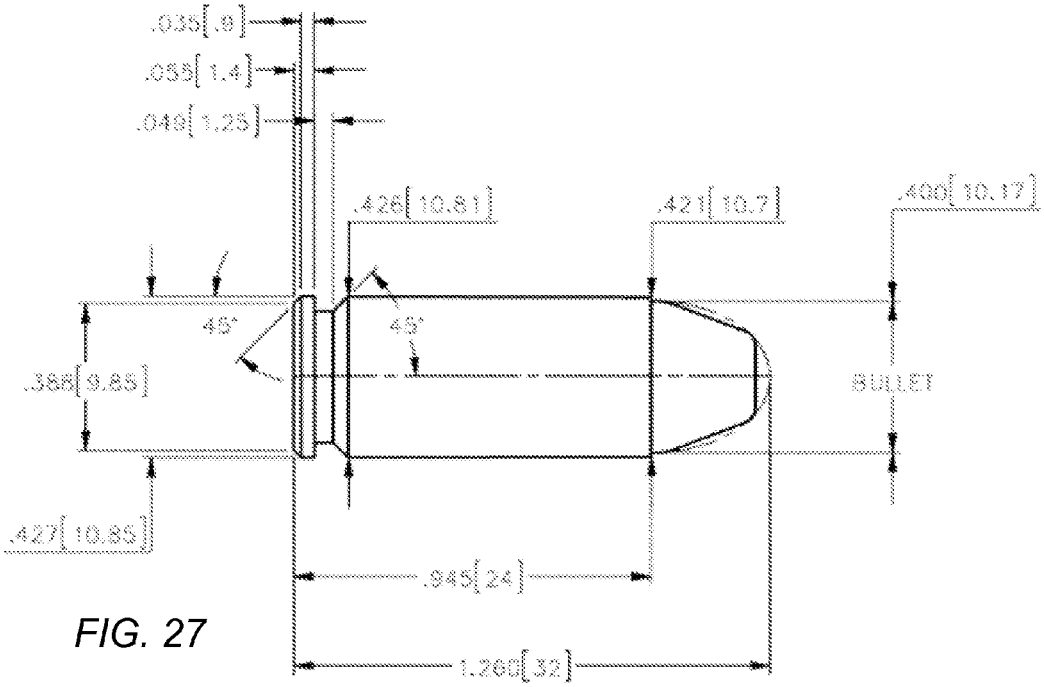
FIG. 27 shows a longitudinal cross section diagram of a 10 mm Coffman cartridge with bullet.
Figure 28A:
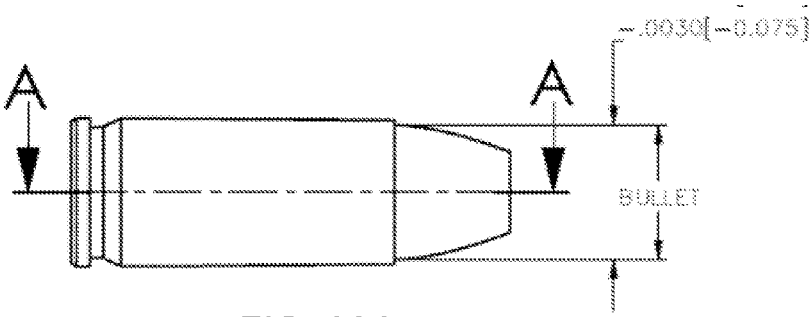
FIG. 28A shows a longitudinal diagram of a .357 Coffman cartridge with bullet.
Figure 28B:
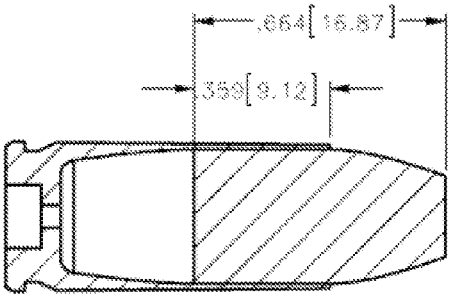
FIG. 28B shows a longitudinal cross section diagram of the .357 Coffman cartridge from FIG. 28A.
Figure 29:
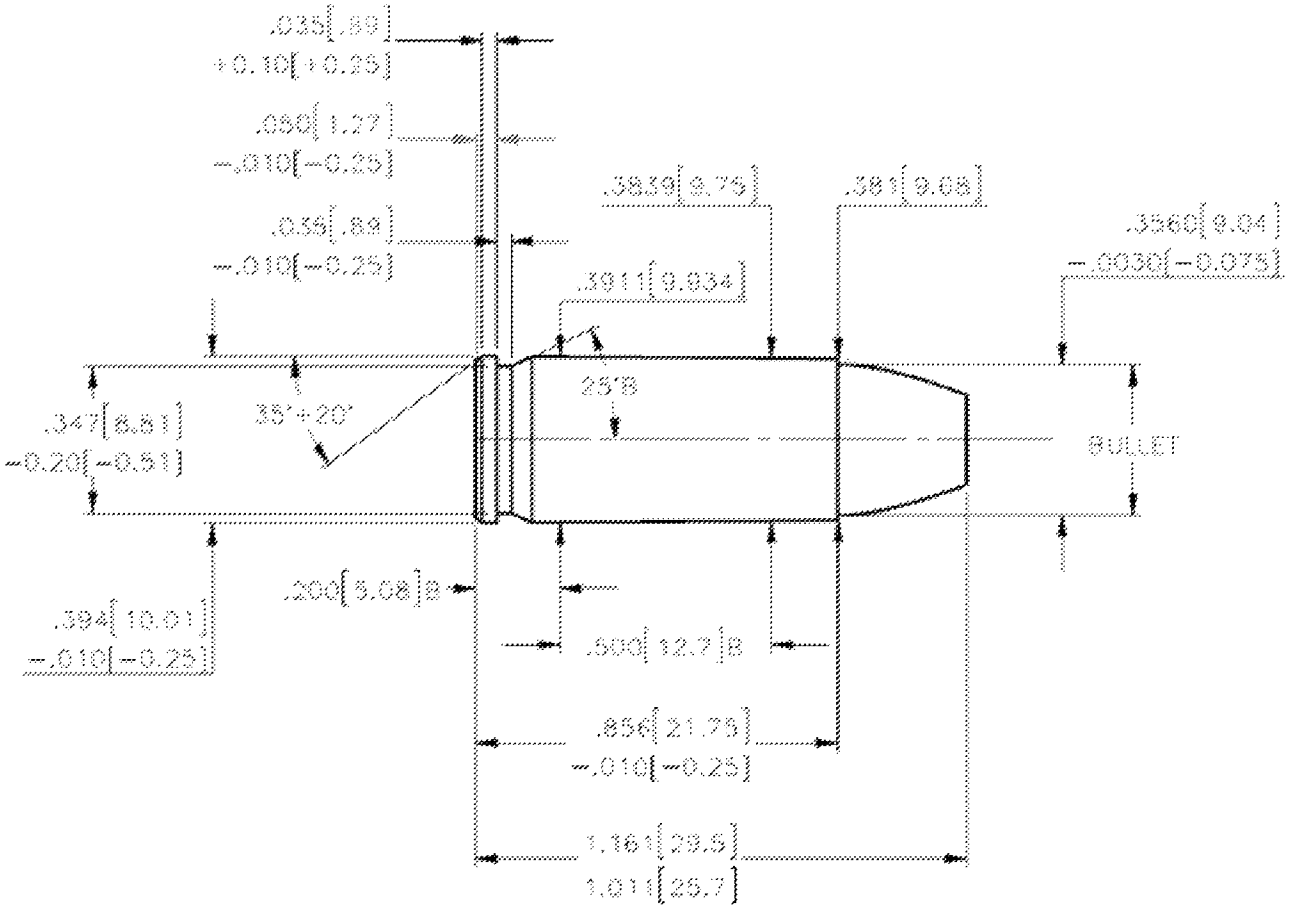
FIG. 29 shows a longitudinal cross section diagram of a .357 Coffman cartridge.
Figure 30:
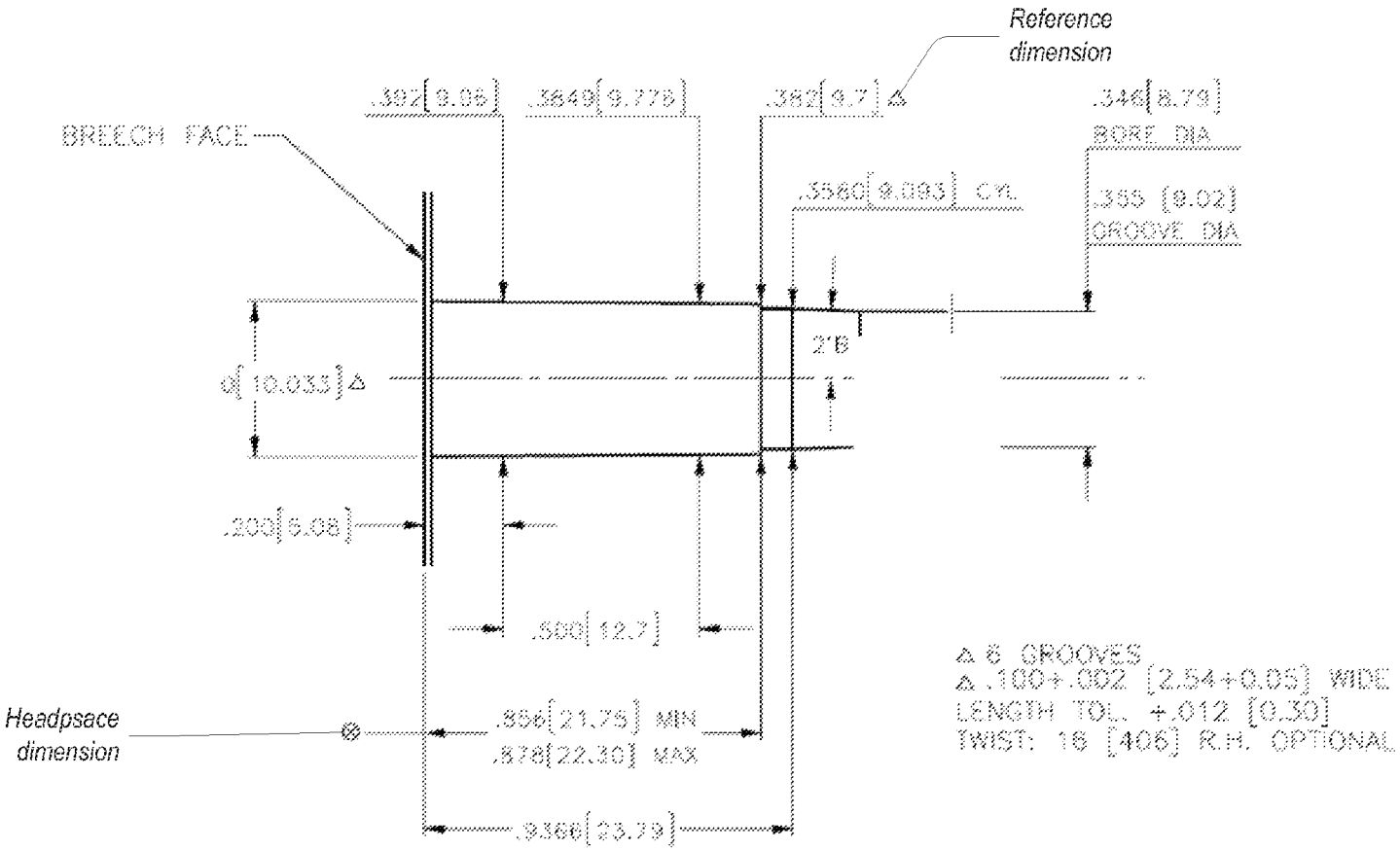
FIG. 30 shows a longitudinal cross section diagram of a .357 Coffman cartridge chamber.
Figure 31:
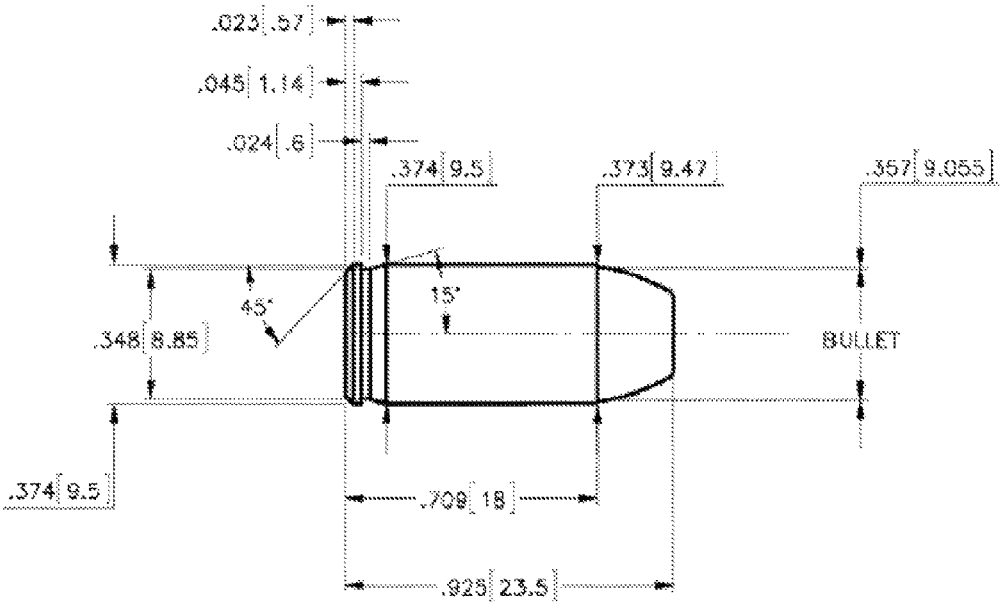
FIG. 31 shows a longitudinal cross section diagram of a .380 Coffman cartridge with bullet.
Figure 32:
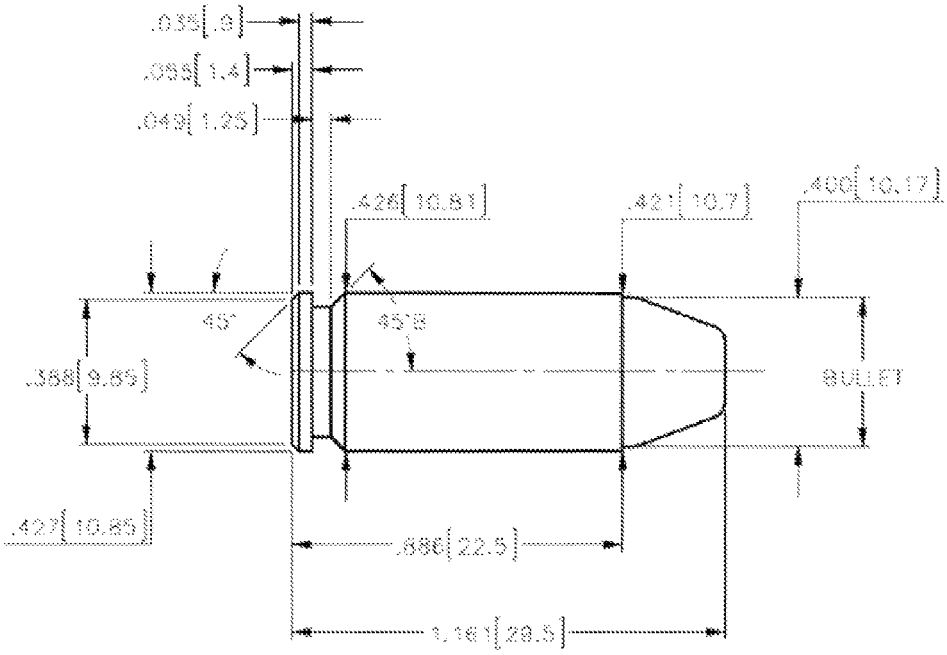
FIG. 32 shows a longitudinal cross section diagram of a .40 Coffman cartridge with bullet.
Figure 33:
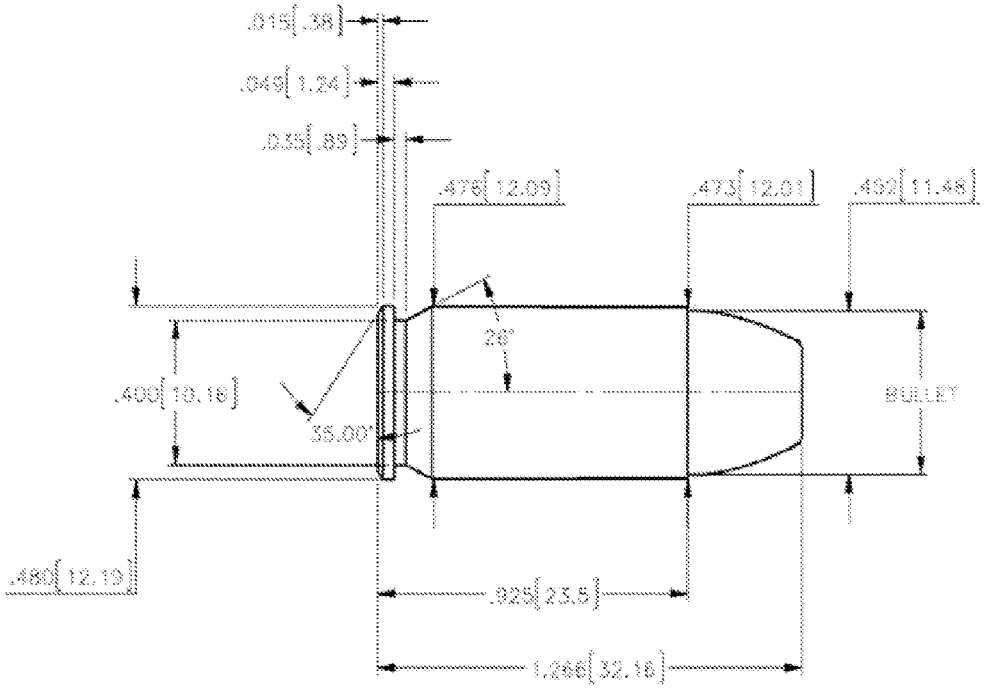
FIG. 33 shows a longitudinal cross section diagram of a .45 Coffman cartridge with bullet.

FIG. 27 shows a longitudinal cross section diagram of a 10 mm Coffman cartridge with bullet. FIG. 28A shows a longitudinal diagram of a .357 Coffman cartridge with bullet, and FIG. 28B shows a longitudinal cross section diagram of the .357 Coffman cartridge of FIG. 28A. FIG. 29 shows a longitudinal cross section diagram of a .357 Coffman cartridge. FIG. 30 shows a longitudinal cross section diagram of a .357 Coffman cartridge chamber. FIG. 31 shows a longitudinal cross section diagram of a .380 Coffman cartridge with bullet. FIG. 32 shows a longitudinal cross section diagram of a .40 Coffman cartridge with bullet. FIG. 33 shows a longitudinal cross section diagram of a .45 Coffman cartridge with bullet.

Figure 34:
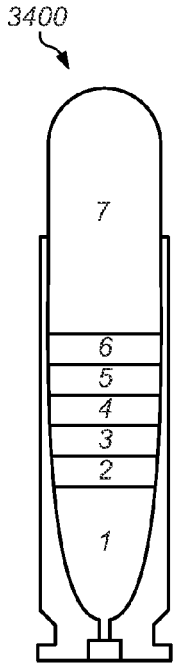
FIG. 34 shows a longitudinal cross section diagram of a cartridge with bullet and loaded powder column(s), according to one embodiment.

FIG. 34 shows a longitudinal cross section diagram of a cartridge 3400 with bullet 7 and loaded powder column(s), according to one embodiment. As shown in FIG. 34, a booster/buffer layer (charge) is configured at the bottom of the cartridge 3400. A next, faster (i.e. faster burning) powder layer 2 is configured atop layer 1. A next, faster powder layer 3 is configured atop layer 2. A buffer layer 4 (slow, low pressure) is configured atop layer 3. A faster burning layer 5 is configured atop layer 4, and is topped by a layer of back burn powder 6 right underneath bullet 7.

Figure 35:
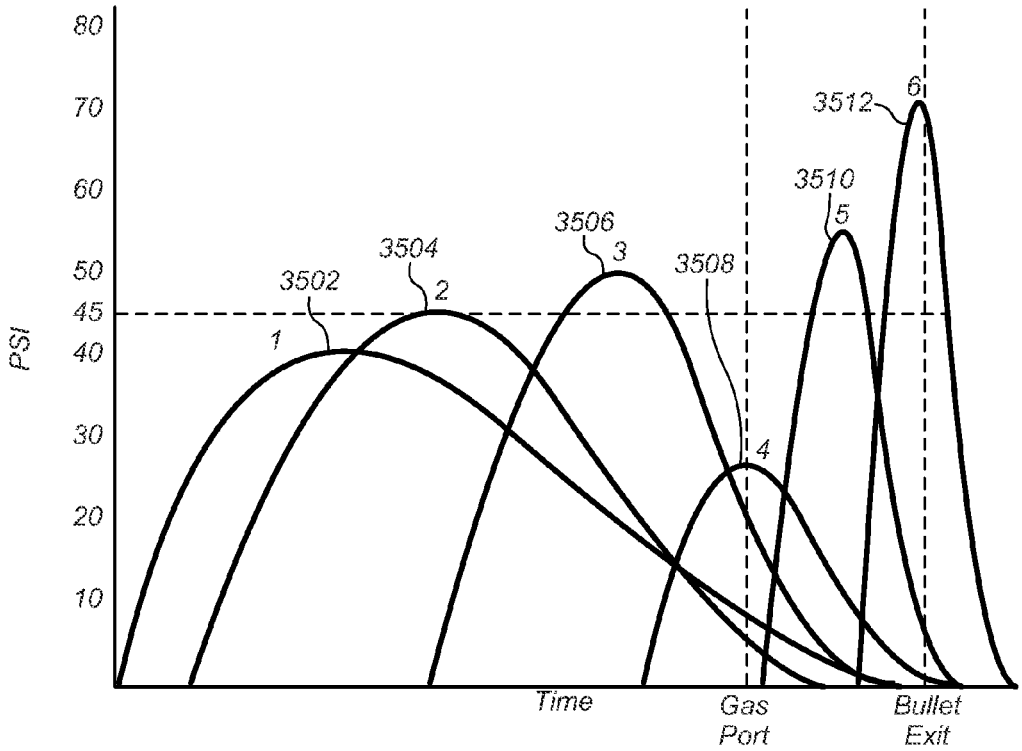
FIG. 35 shows a diagram showing the pressure curves associated with the different powders of FIG. 34 when firing the bullet/cartridge.

FIG. 35 shows a diagram showing the pressure curves associated with the different powders of FIG. 34 when firing the bullet/cartridge. Curve 3502 corresponds to powder layer 1 of FIG. 34, curve 3504 corresponds to powder layer 2 of FIG. 34, curve 3506 corresponds to powder layer 3 of FIG. 34, curve 3508 corresponds to powder layer 4 of FIG. 34, curve 3510 corresponds to powder layer 5 of FIG. 34, and curve 3512 corresponds to powder layer 6 of FIG. 34.

Figure 36:
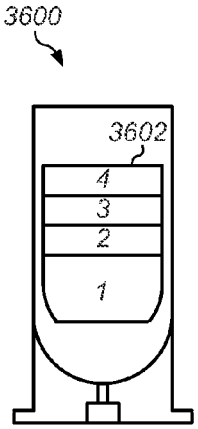
FIG. 36 shows one embodiment of a pellet having a stratified powder load and intended for cartridge chambers.
Figure 37:
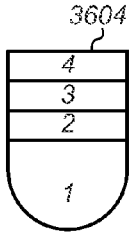
FIG. 37 shows the possible shape of one embodiment of a pellet having a stratified powder load and intended for cartridge chambers.
Figure 38:
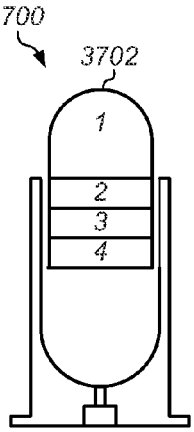
FIG. 38 shows the orientation of a pellet having a stratified powder load, inside a cartridge chamber.

FIG. 36 shows one embodiment of a pellet 3602 having a stratified powder load and situated in a cartridge 3600. As shown in FIG. 36, pellet 3602 contains a stratified powder column including four powder layers 1, 2, 3, and 4. FIG. 37 shows the possible shape of one embodiment of a pellet 3604 having a stratified powder load and intended for cartridges. Pellet 3604 has a square shoulder at powder layer 4, and a rounder profile at the booster layer 1 to match the internal shape of a casing (cartridge). FIG. 38 shows the orientation of a pellet 3702 having a stratified powder load, inside a cartridge 3700 chamber, when the pellet is inserted upside down. As seen in FIG. 38, if pellet 3702 is inserted upside down, it will not seat properly.

Thus, various embodiments of a propellant charge pellet for use in a cartridge may include a propellant column of stratified stacked layers of propellant, where each respective layer of propellant of the stratified stacked layers of propellant is compressed to a specified degree, and a respective burn rate of each respective layer of propellant is controlled by the specified degree of compression applied to the respective layer of propellant. The first layer of propellant of the stratified stacked layers of propellant may have a burn rate corresponding to a maximum chamber pressure of the cartridge, and the respective burn rate of each respective layer of propellant may be further controlled by a specified volume of the respective layer of propellant. As shown in FIG. 37, the pellet may have a square profile at a first end where a top layer of propellant of the stratified stacked layers of propellant is situated, and a round profile at a second end where a bottom layer of propellant of the stratified stacked layers of propellant is situated. Furthermore, adjacent layers of propellant of the stratified stacked layers of propellant may be in direct contact with each other.

Figure 39:
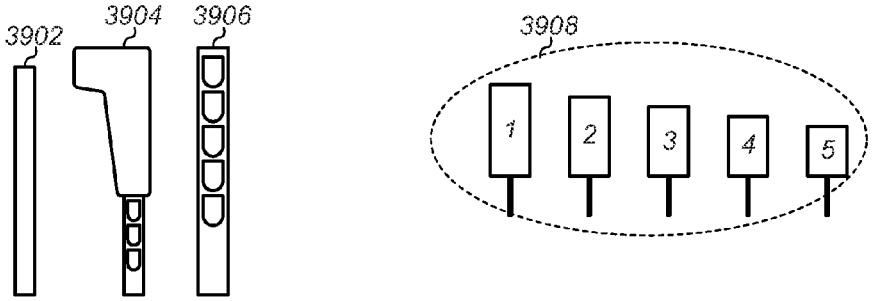
FIG. 39 shows a diagram of various embodiments of commercial/personal cartridge reloading implements.

FIG. 39 shows a diagram of various embodiments of commercial/personal cartridge reloading implements according to one set of embodiments. One reloading system may include a primer tube 3902 and a case feed 3904. Case feed 3904 may be used to fill tube 3902 with factory packaged pellets that were manufactured according to the system and methods described herein, to yield a filled primer tube 3906. The tube may be inserted into the fitting, and may be prevented from fitting upside down. Alternately, progressive powder drops 3908 may be employed.

Various embodiments of cartridges disclosed herein feature stratified layers of more than one powder under compression, adapted to propel the powder column forward along with the projectile. Shaped charges may be used in the powder column, and a shaped charge disc may be seated as the last stage of ignition. The overall cartridge construction results in a uniform linearly or exponentially accelerated motion of the projectile shot from the cartridge through a barrel.

Although the embodiments above have been described in some detail, numerous variations and modifications will become apparent to those skilled in the art once the above disclosure is fully appreciated.

I claim:

1. A propellant charge pellet comprising:

a propellant column comprising a plurality of stratified stacked layers of propellant, wherein each layer of propellant of the plurality of stratified stacked layers of propellant is compressed to a specified degree, wherein a burn rate of each layer of propellant is controlled by the specified degree of compression applied to each layer of propellant, wherein a burn rate of a first propellant layer of the plurality of stratified layers is slower than a burn rate of a second propellant layer of the plurality of stratified layers, and wherein the first propellant layer is adjacent to the second propellant layer, wherein the first propellant layer of propellant of the stratified stacked layers of propellant has a burn rate corresponding to a maximum chamber pressure of a cartridge.

2. The propellant charge pellet of claim 1, wherein the burn rate of each layer of propellant is further controlled by a specified volume of the layer of propellant.

3. The propellant charge pellet of claim 1, wherein the propellant charge pellet has a square profile at a first end where a top layer of propellant of the stratified stacked layers of propellant is situated, and a round profile at a second end where a bottom layer of propellant of the stratified stacked layers of propellant is situated.

4. The propellant charge pellet of claim 1, wherein adjacent layers of propellant of the stratified stacked layers of propellant are in direct contact with each other.

5. A propellant charge comprising a plurality of propellant layers stratified in a stacked column, wherein each propellant layer of the plurality of propellant layers is compressed to a specified degree, wherein the compression of a first layer of the plurality of stratified layers forms a predetermined shape;

wherein a burn rate of each propellant layer is controlled by a specified volume of the propellant layer and the specified degree of compression applied to the propellant layer, and wherein a burn rate of a first layer of the plurality of stratified layers is slower than a burn rate of a second layer of the plurality of stratified layers, wherein the first layer is adjacent to the second layer, and wherein the specified degree of compression applied to a first propellant layer of the plurality of propellant layers results in a burn rate corresponding to a maximum chamber pressure of a cartridge.

6. The propellant charge of claim 5, wherein the first layer of propellant is a booster layer, wherein the specified degree of compression applied to the booster layer results in detonation of the at least one other layer, following detonation of the booster layer during firing of a projectile from the cartridge, to occur after the projectile in is motion.

7. The propellant cartridge of claim 5, wherein the predetermined shape is selected from the group consisting of a square profile or a round profile.

8. A cartridge comprising:

a casing;

a propellant chamber defined by the casing;

a projectile coupled to the casing; and a powder column in the propellant chamber, wherein the powder column comprises a plurality of stratified stacked propellant layers, wherein each propellant layer of the plurality of stratified stacked propellant layers comprises a plurality of grains and is compressed to a specific degree, and wherein at least one propellant layer of the plurality of stratified stacked propellant layers is compressed by at least two grains of the plurality of grains associated with the at least one propellant layer, wherein a burn rate of each propellant layer is controlled by the specified degree of compression applied to the propellant layer, wherein a first layer of propellant of the plurality of stratified layers of propellant is disposed further away from the projectile than subsequent propellant layers and initiates a detonation of at least an adjacent propellant layer, and wherein the first propellant layer comprises a burn rate corresponding to a predetermined chamber pressure of the cartridge.

9. The cartridge of claim 8, wherein the projectile is coupled to the casing above the propellant chamber.

10. The cartridge of claim 9, wherein a top propellant layer of the stratified stacked propellant layers is press fitted into a base cup of the projectile.

11. The cartridge of claim 9, wherein the first propellant layer of the plurality of propellant layers press is fitted at a bottom of the powder column and is a booster layer, wherein the detonation of the at least one adjacent propellant occurs after the projectile in is motion.

12. The cartridge of claim 9, wherein the first propellant layer of the plurality of propellant layers is press fitted at a bottom of the powder column is a booster layer, wherein the specified degree of compression applied to the booster layer results in a volume of the casing increasing prior to detonation of the at least one adjacent propellant layer of the stratified stacked propellant layers following detonation of the booster layer during firing of the projectile.

13. The cartridge of claim 9, wherein during firing of the projectile from the cartridge through a barrel, the powder column is completely burned up by a point in time at which the projectile leaves the barrel.

14. The cartridge of claim 9, wherein the specified degree of compression applied to each propellant layer of the stratified stacked propellant layers results in a rapidly increasing set of sequential ignitions during firing of the projective from the cartridge through a barrel, wherein each successive ignition of the set of sequential ignitions provides a higher energy density, and creates a more uniform linear acceleration of the projectile for a full length of the barrel.

15. The cartridge of claim 8, wherein the burn rate of each propellant layer is further controlled by a specified volume of the propellant layer.

16. The cartridge of claim 8, wherein adjacent propellant layers of the stratified stacked propellant layers are not separated by a hermetic barrier.

17. The cartridge of claim 8, wherein the predetermined chamber pressure of the cartridge is a maximum pressure of the cartridge.

* * * * *